US006139404A

United States Patent [19]

Yau

[11] Patent Number: 6,139,404

[45] **Date of Patent: *Oct. 31, 2000**

[54] APPARATUS AND A METHOD FOR CONDITIONING A SEMICONDUCTOR WAFER POLISHING PAD

[75] Inventor: Leopoldo D. Yau, Portland, Oreg.

[73] Assignee: Intel Corporation, Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/009,469

[22] Filed: Jan. 20, 1998

[51] Int. Cl.[7] ..... B24B 1/00

[52] U.S. Cl. ..... 451/56; 451/444; 451/443

[58] Field of Search ..... 451/41, 56, 54, 451/60, 63, 38, 443, 444, 442, 178, 242

[56] References Cited

U.S. PATENT DOCUMENTS

| | | | |
|---|---|---|---|
| 5,081,051 | 1/1992 | Mattingly et al. | 451/56 |
| 5,486,131 | 1/1996 | Cesna et al. | 451/444 |
| 5,547,417 | 8/1996 | Breivogel et al. | 451/58 |
| 5,611,943 | 3/1997 | Cadien et al. | 451/287 |
| 5,645,682 | 7/1997 | Skrovan | 451/56 |
| 5,651,725 | 7/1997 | Kikuta et al. | 451/444 |
| 5,665,656 | 9/1997 | Jairath | 451/287 |
| 5,674,109 | 10/1997 | Kanzawa et al. | 451/287 |
| 5,709,593 | 1/1998 | Guthrie et al. | 451/287 |
| 5,775,983 | 7/1998 | Shendon et al. | 451/444 |
| 5,785,585 | 7/1998 | Manfredi et al. | 451/444 |

*Primary Examiner*—Derris H. Banks

*Attorney, Agent, or Firm*—Blakely, Sokoloff, Taylor & Zafman LLP

[57] ABSTRACT

A semiconductor wafer polishing pad conditioner which includes a support structure and a roller which is rotatably mounted to the support structure. The roller has a working surface which is formed with a plurality of blades.

37 Claims, 14 Drawing Sheets

APPARATUS AND A METHOD FOR CONDITIONING A SEMICONDUCTOR WAFER POLISHING PAD

BACKGROUND OF THE INVENTION

1. Field of the Invention

The present invention relates generally to semiconductor wafer processing apparatus and, more specifically, to a semiconductor wafer processing apparatus including a semiconductor wafer polishing pad and a semiconductor wafer polishing pad conditioner, and to a method of conditioning a semiconductor wafer polishing pad.

2. Discussion of Related Art

Semiconductor chips are manufactured by forming consecutive layers on a semiconductor wafer substrate. One or more of the layers are usually polished in a process which has become known in the art as "chemical-mechanical polishing" (CMP). CMP generally involves the steps of locating a wafer on a polishing pad with the layer which has to be polished on an interface between the wafer and the polishing pad. The wafer and the polishing pad are then moved over one another. A slurry is introduced on the polishing pad. The polishing pad has an abrasive surface so that movement of the wafer and the polishing pad over one another results in a gradual removal of the layer.

The material of the slurry and of the wafer eventually builds up on the polishing pad so that the polishing pad becomes "glazed" over with these materials. The glazed materials have to be removed from time to time so that the polishing pad is "conditioned" for further polishing.

FIG. 1 of the accompanying drawings is a plan view illustrating one conventional method of polishing a wafer and conditioning a polishing pad which polishes the wafer. A circular semiconductor wafer 20 is located on a circular semiconductor wafer polishing pad 22. The polishing pad 22 is rotated in a direction 24 to polish the wafer 20. A semiconductor wafer polishing pad conditioning arm 26 is mounted at a pivot point 28 so as to sweep back and forth over the polishing pad 22. One or more pointed members, such as diamond points, are located on a head 30 of the arm 26. Back and forth pivoting of the arm causes the pointed member to scrape back and forth over a surface of the polishing pad 22. The polishing pad 22 is rotated while the pointed member scrapes over the surface thereof so that the member conditions the polishing pad 22 in a zig zag manner. The wafer 20 has a diameter which is less than half the diameter of the polishing pad 22, thus leaving enough space for the polishing pad 22 to be conditioned while the wafer 20 is being polished.

FIG. 2 is a plan view illustrating another conventional method of polishing a wafer. A wafer 32 is located on a polishing pad 34 and the polishing pad 34 is rotated in a direction 36 so that the polishing pad 34 moves over the wafer 32. The method illustrated in FIG. 2 has distinct advantages over the method illustrated in FIG. 1 since the polishing pad 34 moves over the wafer 32 with a small orbital radius which results in more uniform motion between different points of the wafer 32. Mechanisms may be employed to control rotation of the wafer 32 relatively to the polishing pad 34. The wafer 32 has a diameter which is more than half the diameter of the polishing pad 34. A central region of the polishing pad 34 therefore remains covered by the wafer 32 at all times. In order to condition the polishing pad 34, the wafer 32 has to be removed. The conditioning of the wafer 34 is therefore a step in series with polishing of the wafer 34. In order to increase throughput, apparatus and a method for conditioning a polishing pad is required wherein conditioning of the polishing pad 34 is done efficiently.

SUMMARY OF THE INVENTION

The invention relates to a semiconductor wafer processing apparatus which includes a support structure, a semiconductor wafer polishing pad and a conditioning blade. The conditioning blade is mounted to the mounting structure for movement wherein the blade scrapes over a surface of the semiconductor wafer polishing pad during at least a portion of the movement.

BRIEF DESCRIPTION OF THE DRAWINGS

The invention is further described by way of examples with reference of the accompanying drawings wherein.

DESCRIPTION OF PREFERRED EMBODIMENTS

In the following description, for purposes of explanation, numerous details are set forth in order to provide a thorough understanding of the present invention. However, it will be apparent to one skilled in the art that these specific details are not required in order to practice the present invention. Certain specifics regarding, for example, apparatus and methods are recited. These specifics are recited in order to provide examples of workable embodiments of the invention, and may be altered according to preference or requirement without departing from the broader scope of the invention as claimed.

The present invention relates to conditioning of a polishing pad which is used for polishing a semiconductor wafer. A roller is provided having a plurality of blades on a surface thereof. The roller is swept over a surface of the polishing pad. The roller is rotated at the same time so that the blades scrape over the surface.

In the description that follows liberal use is made of the term "blade", which should not necessarily be interpreted as having a sharp edge. A more important feature of a "blade" for purposes of the present invention is that the blade should be able to make line contact.

Figure 3:
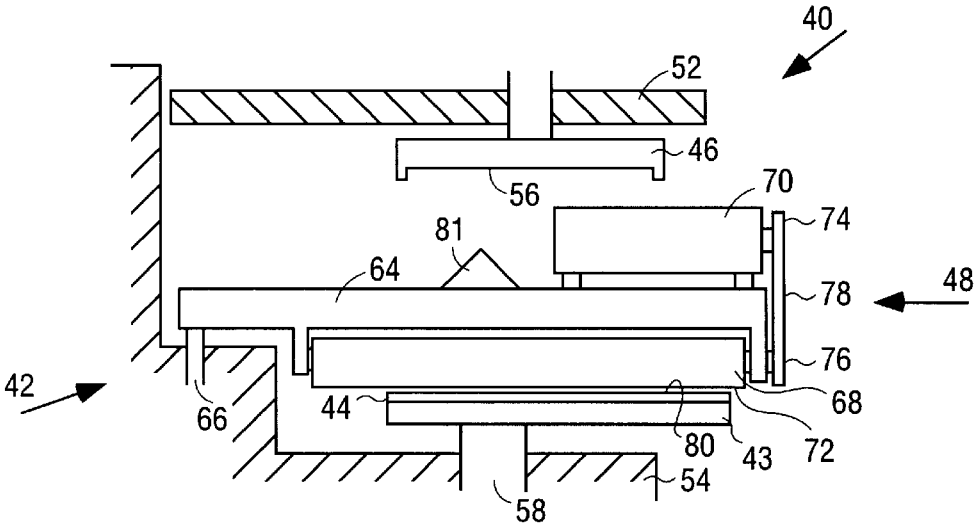
FIG. 3 is a side view of a semiconductor wafer processing apparatus according to one form of the invention.

FIG. 3 of the accompanying drawings illustrates semiconductor wafer processing apparatus 40 according to the invention. The apparatus 40 includes a support structure 42, a rotatable table 43 with a semiconductor wafer polishing pad 44 served thereon, a semiconductor wafer carrier 46, and a semiconductor wafer polishing pad conditioner 48 according to the invention.

The support structure 42 includes a main frame 50 and an overhead structure 52 which is mounted for vertical movement to the main frame 50. The rotatable table 43 is located on a bed 54 of the main frame 50 and the carrier 46 is located in the overhead structure 52.

The carrier 46 defines a recess 56 for receiving a semiconductor wafer.

Figure 4:
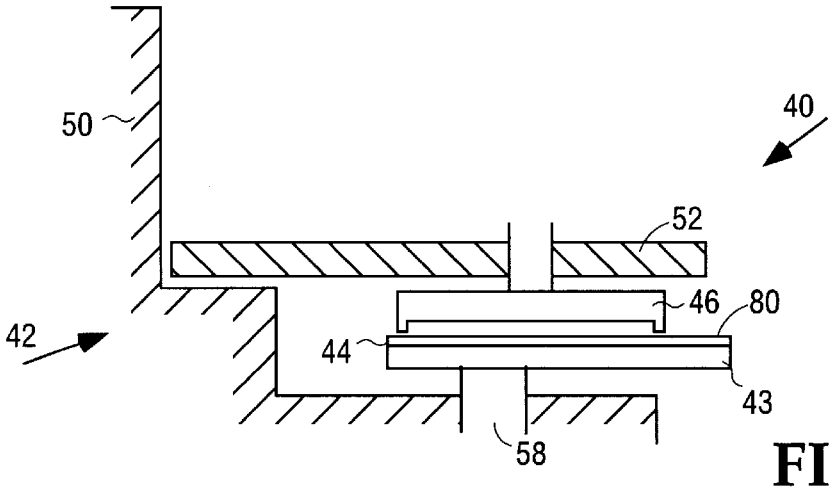
FIG. 4 is a view similar to FIG. 3 in a wafer polishing mode.

FIG. 4 is a view similar to FIG. 3 wherein the overhead structure 52 is lowered towards the bed 54 so that a wafer, when located within the recess 56, is moved into contact with the polishing pad 44. Mechanisms (not shown) are provided for moving the carrier 46 and the rotatable table 43 relatively to one another so that the wafer is "buffed" against the polishing pad 44. Of importance in this respect is to note that the polishing pad 44 has an eccentric shaft 58 which, when rotated, moves the polishing pad 44 with a small circle on the wafer 46. The carrier 46 may also be rotated to obtain certain polishing effects. Particulars of the polishing effects are not material to the present invention. Suffice to say that the polishing pad 44 moves over the wafer 46 with a small orbital radius which results in more uniform motion between different points of the wafer 46.

Figure 5:
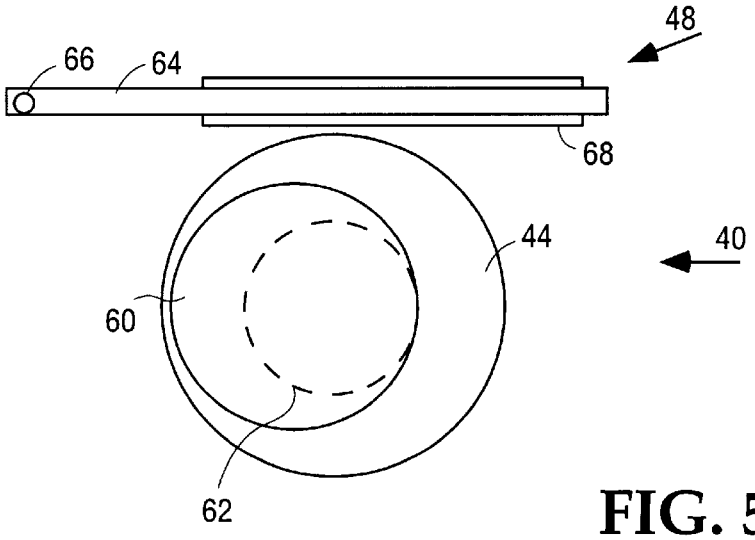
FIG. 5 is a plan view illustrating polishing of a wafer in the mode shown in FIG. 4.

FIG. 5 is a plan view illustrating polishing of a semiconductor wafer 60 utilizing the apparatus of FIG. 4. The wafer 60 has a diameter which is more than half the diameter of the polishing pad 44 so that a central region, indicated with dotted line 62, of the polishing pad 44 is always covered by the wafer 60. The wafer 60 thus has to be removed from the polishing pad 44 in order to condition the polishing pad 44. An efficient apparatus is therefore required for purposes of conditioning the polishing pad 44 since conditioning of the wafer is a step in series in the overall polishing process. The conditioner of the invention has particular application for a carrier-and-polishing pad configuration as shown in FIG. 5 wherein the wafer always covers a region of the polishing pad 44, but it should be understood that the conditioner of the invention may also find application for purposes of conditioning polishing pads of polishing apparatus having other configurations. One such configuration is discussed hereinbelow with reference to FIG. 17.

Referring again to FIG. 3 and 5, the conditioner 48 includes a mounting arm 64 which is pivotally mounted to the main frame 50 at a pivot connection 66, a semiconductor wafer polishing pad conditioner roller 68, and a motor 70.

The roller 68 is rotatably mounted to the arm 64 and has a working surface 72 which is substantially parallel to the polishing pad 44. The working surface 72 is shown spaced from the polishing pad 44, but it should be understood that this is done merely for illustration purposes and that the working surface 72 is substantially level with the polishing pad 44.

The motor 70 is mounted on top of a mounting arm 64 and drives the roller 68 through two pulleys 74 and 76, on the motor 70 and the roller 68 respectively, and a belt 78 running over the pulleys 74 and 76. The conditioner 48 is sized to fit between the carrier 46 and the polishing pad 44 when the overhead structure 52 is raised. Pivoting of a mounting arm 64 sweeps the roller 68 over a surface 80 of the polishing pad 44. A weight 81 is located on the arm 64 so that the roller 68 bears down on the polishing pad 44. An alternative device, such as a spring or a pressurized cylinder, may be used to push the roller 68 down onto the polishing pad 44.

Figure 6:
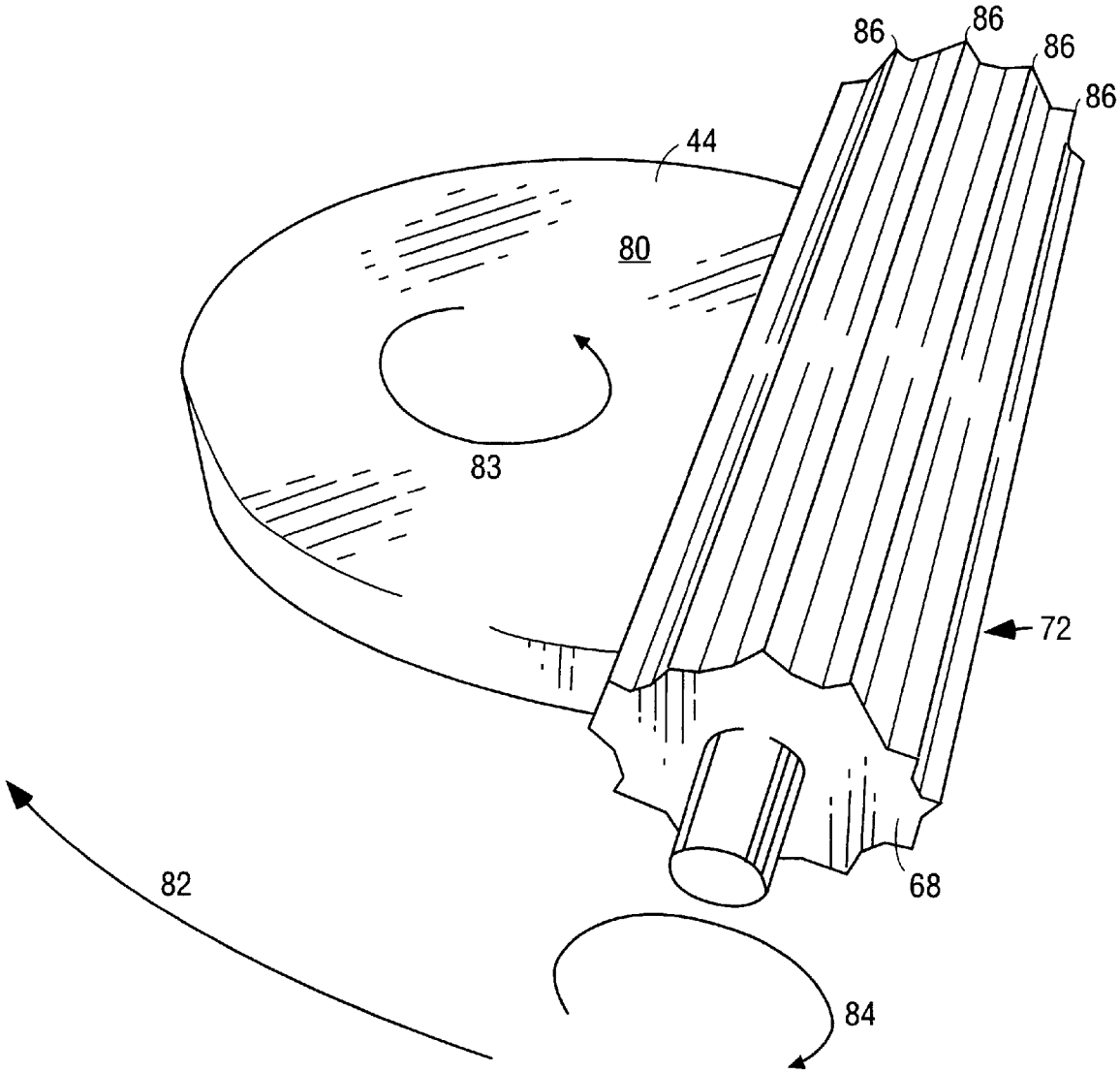
FIG. 6 is a perspective view of a semiconductor wafer polishing pad conditioner roller, according to the invention, which initiates conditioning of a semiconductor wafer polishing pad.
Figure 7:
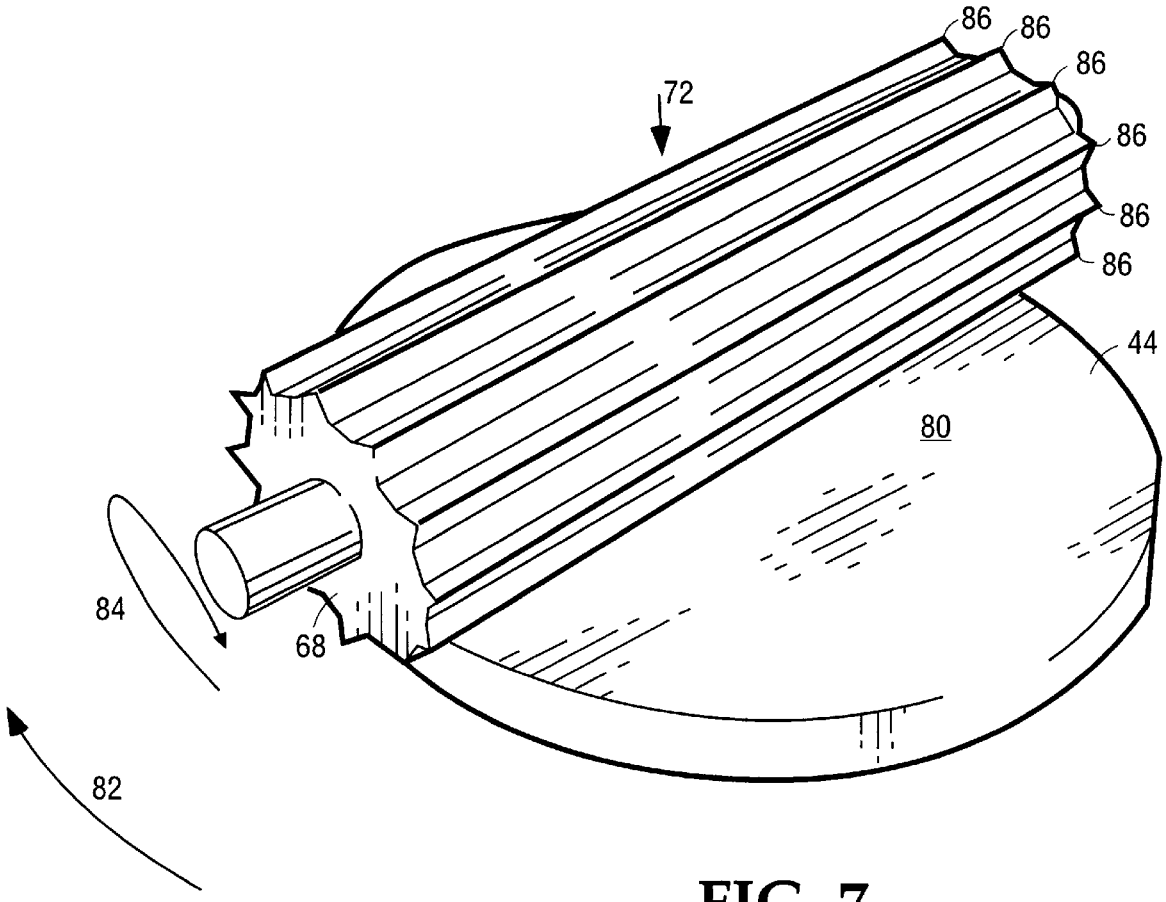
FIG. 7 is a perspective view of the roller of FIG. 6 during conditioning of the polishing pad.
Figure 8:
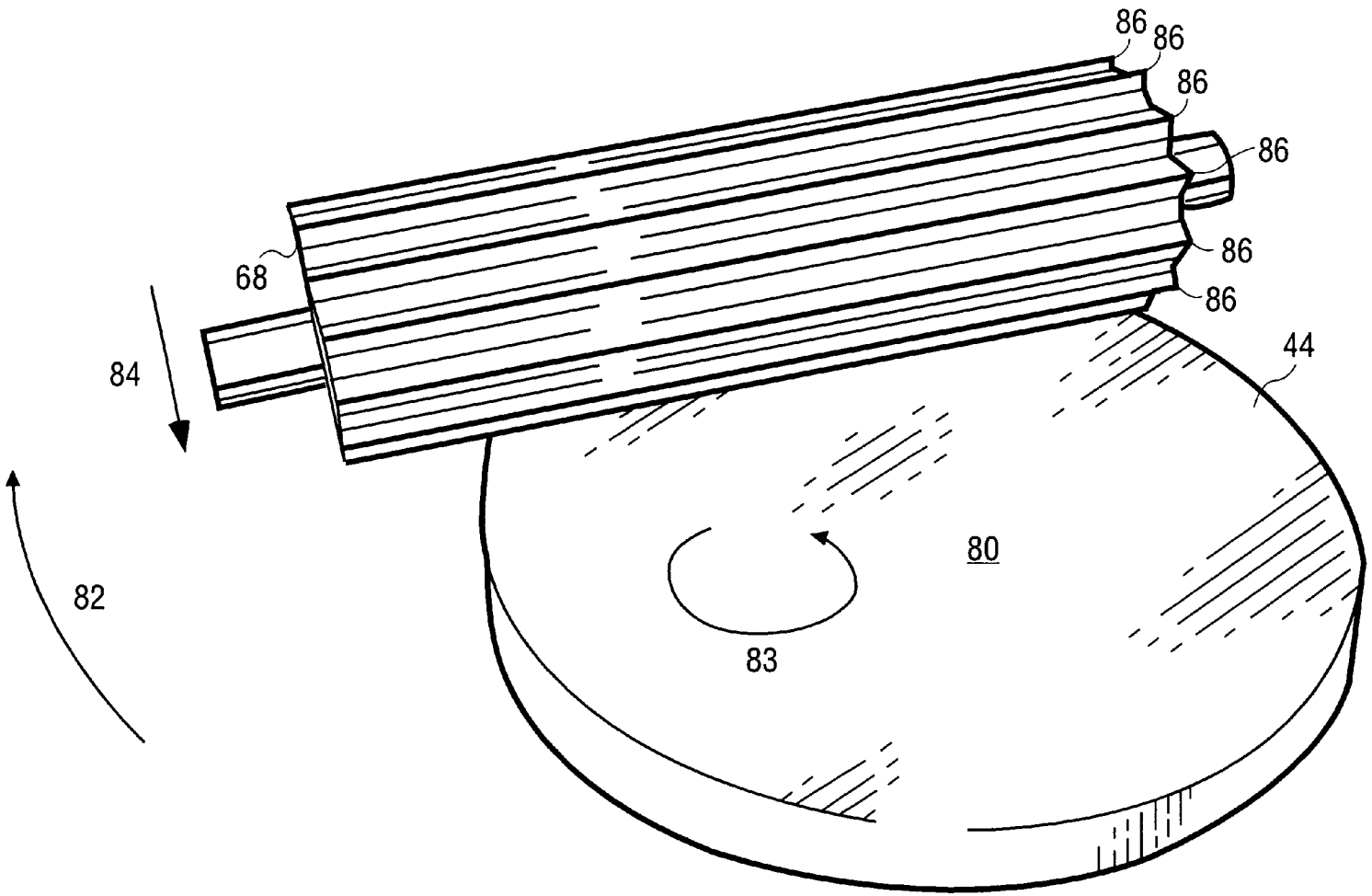
FIG. 8 is a perspective view of the roller of FIG. 7 which finalizes conditioning of the polishing pad.

FIGS. 6, 7 and 8 illustrate the working of the roller 68 during conditioning of the polishing pad 44. The roller 68 is first swept over the surface 80 in a direction 82. The roller 68 is rotated in a direction 84 so that the working surface 72 of the roller 68 initially moves over the polishing pad 44. As mentioned earlier, the polishing pad 44 is orbital in a direction 83 about the eccentric shaft 58. The polishing pad 44 may be conditioned while the polishing pad 44 is stationary or while the polishing pad 44 is rotated.

Figure 9:
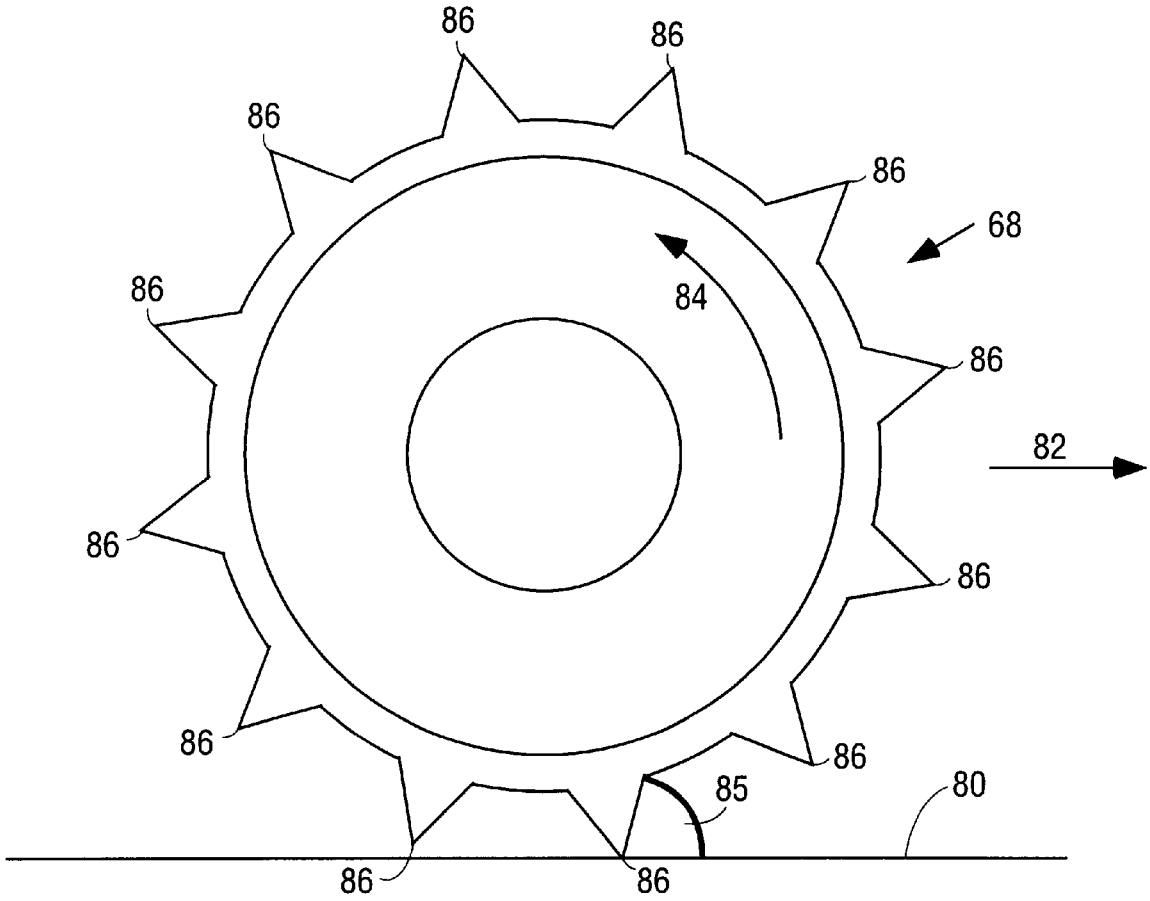
FIG. 9 is an end view of the roller of FIGS. 6, 7 and 8.

The working surface 72 comprises a plurality of blades 86 around a circumference of the roller 68 and extending along the length of the roller 68. FIG. 9 shows how the blades 68 scrape the surface 80. The blades 86 consecutively contact the surface 80 when the roller 68 rotates in the direction 84 so that the blades 86 scrape up any material 85 located on the surface 80 of the polishing pad 44. As also shown in FIGS. 7 and 8 the roller 68 also sweeps in the direction 82 so that the entire surface 80 of the polishing pad 44 is conditioned. Any material which is scraped up from the surface 80 may then be washed away utilizing an appropriate fluid. Once the roller 68 finalizes conditioning, as shown in FIG. 8, any material collected by the roller 68 may be cleared off the surface 80 of the polishing pad 44.

Once the roller 68 reaches the position shown in FIG. 8, the direction 82 in which the roller 68 sweeps over the surface 80 is reversed to return the roller to the position shown in FIG. 6 while the roller maintains rotation in the direction 84 or after the direction 84 is reversed.

Figure 1:
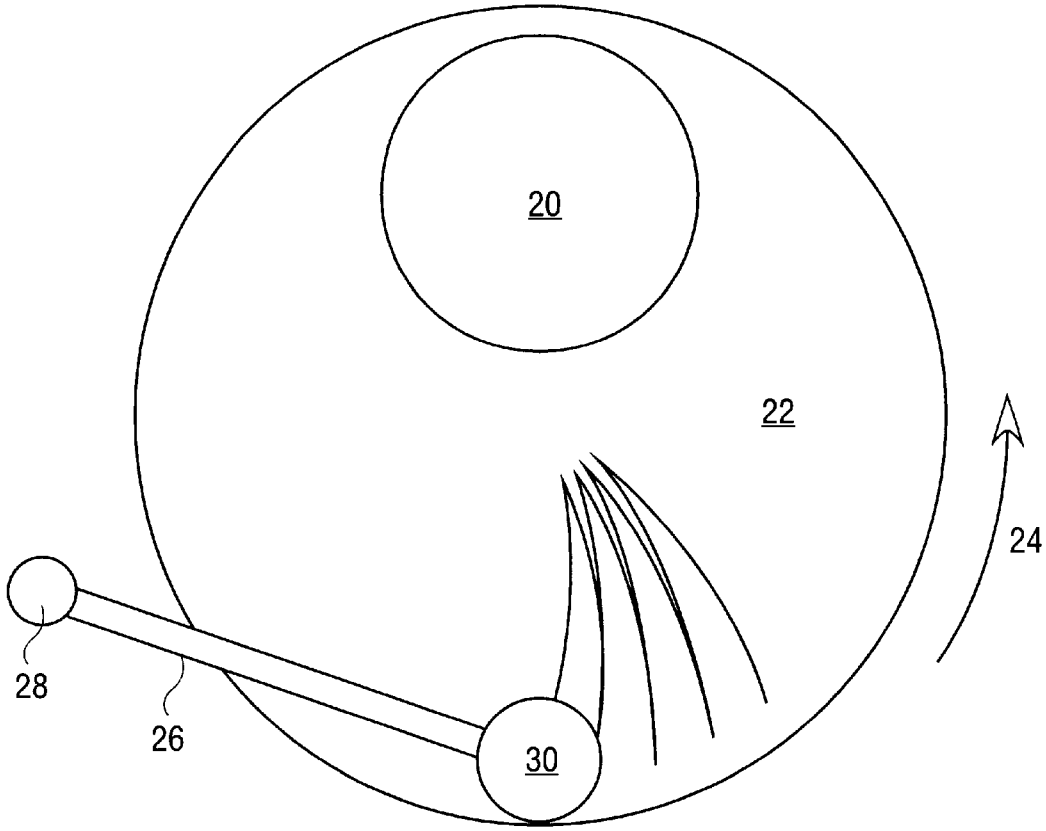
FIG. 1 (PRIOR ART)
FIG. 1 is a plan view illustrating one conventional method of polishing a wafer and conditioning a polishing pad which polishes the wafer.
Figure 2:
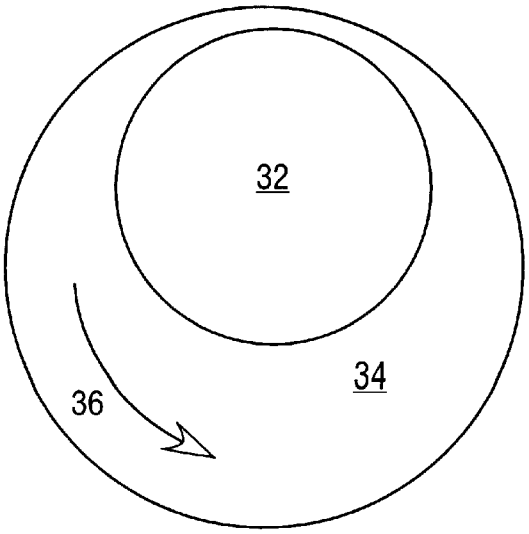
FIG. 2 (PRIOR ART)
FIG. 2 is a plan view illustrating another conventional method of polishing a wafer.

One reason why the present invention can condition a polishing pad relatively efficiently is because blades 86 are used for purposes of contacting the surface 80. The blades 86 make line contact on the surface 80, which allows for the surface 80 to be scraped in a manner which covers a larger area of the surface 80 as opposed to the conventional method of making finite point of contact with a polishing pad (see FIG. 1).

Another reason why the apparatus of the present invention can clean the surface relatively efficiently is because members, in the form of the blades 68, are mounted for rotational movement to scrape the surface 40. A device in the form of the motor 70, may then be used for directing the members repeatedly over the surface 80. Although, in the present embodiment, the blades are conveniently located on a roller, it should be understood that the blades may alternatively be mounted for orbital movement. Such orbital movement may be in a path other than circular, such as in an oval path or any other orbital path. One such an embodiment would comprise a flexible belt which is mounted between two rollers for movement in an orbital path. In order to increase speed of conditioning a larger number of blades may be provided, or the rotation speed of the roller may be increased.

Yet a further reason why the apparatus of the present invention can clean the surface 80 relatively efficiently is because the roller is wider than the surface 80 and it conditions the entire surface 80 in one or two sweeps over the surface 80. Although the present invention has been described with reference to blades 86 making contact with the surface 80, another embodiment, such as a roller brush conditioner, may be envisaged wherein members other than blades are used, but traveling in a similar manner as hereinbefore described. Such an embodiment may obtain the similar results.

Figure 10:
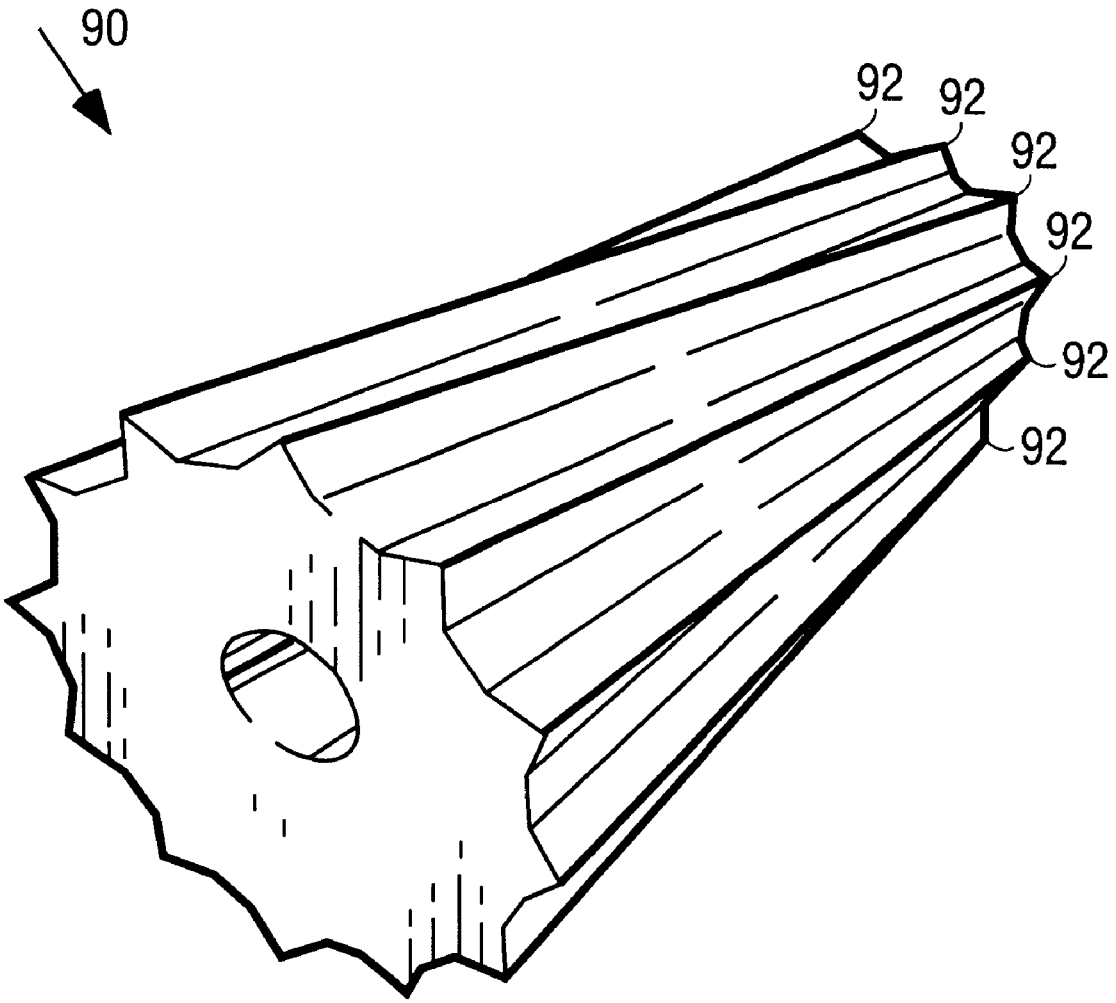
FIG. 10 is a perspective view of a roller according to an alternative embodiment of the invention, wherein the roller has helical blades.
Figure 11:
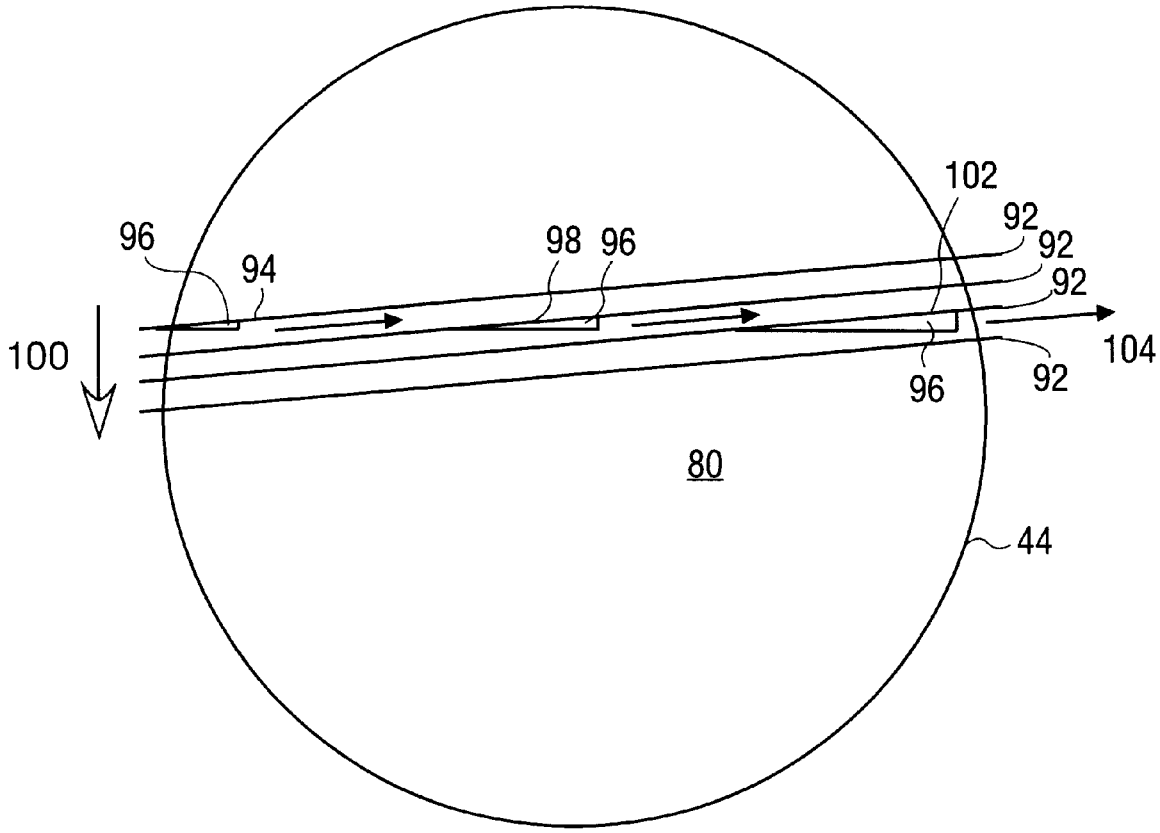
FIG. 11 is a view illustrating the working of the roller of FIG. 10.

The embodiment as hereinbefore described utilizes blades 86 which extend along the length of the roller 68 in a non-helical manner. The entire length of each blade 86 makes contact with the surface 80 at the same time and then removes material from the surface 80 along its entire length at the same time. FIG. 10 shows an alternative roller 90 which has blades 92 which are helical. FIG. 11 illustrates the operation of the blades 92 when conditioning the surface 80 of the polishing pad 44. Each blade 92 first strikes the surface 80 with an end 94 thereof. Only the end 94 is initially in contact with the surface 80 and only the end 94 removes any material 96 from the surface 80.

The roller 90 then rotates further so that a central section 98 of the blade 92 comes into contact with the surface 80. As the roller 90 rotates, the material 96 is moved in a direction which has a component which is transverse to a direction 100 in which the blade 92 travels. At the same time more material is collected from the surface 80. The roller 90 continues to rotate until an opposing end 102 of the blade 92 comes into contact with the surface 80. The material 96 is then dispelled off the surface 80 in a direction which has a component 104 which is transversed to the direction 100 in which the blade 92 travels.

It should be noted that more than one blade makes contact with the surface 80 at the same time so that the entire width of the surface 80 is conditioned. Helical blades are advantageous in that they make smooth contact and rotate smoothly on the surface 80.

Figure 12:
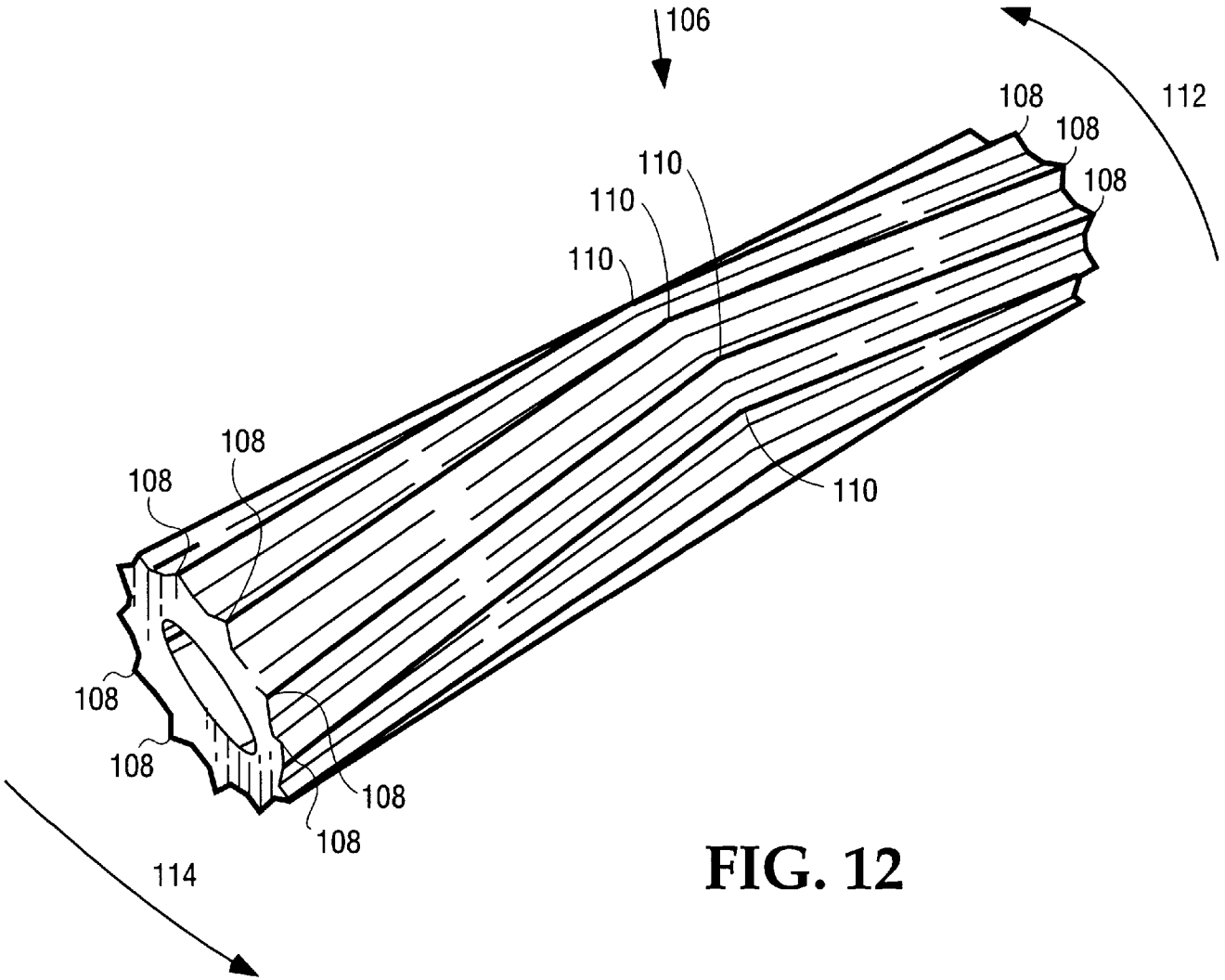
FIG. 12 is a perspective view of a roller according to yet another form of the invention, wherein the roller has "V"-shaped helical blades.
Figure 13:
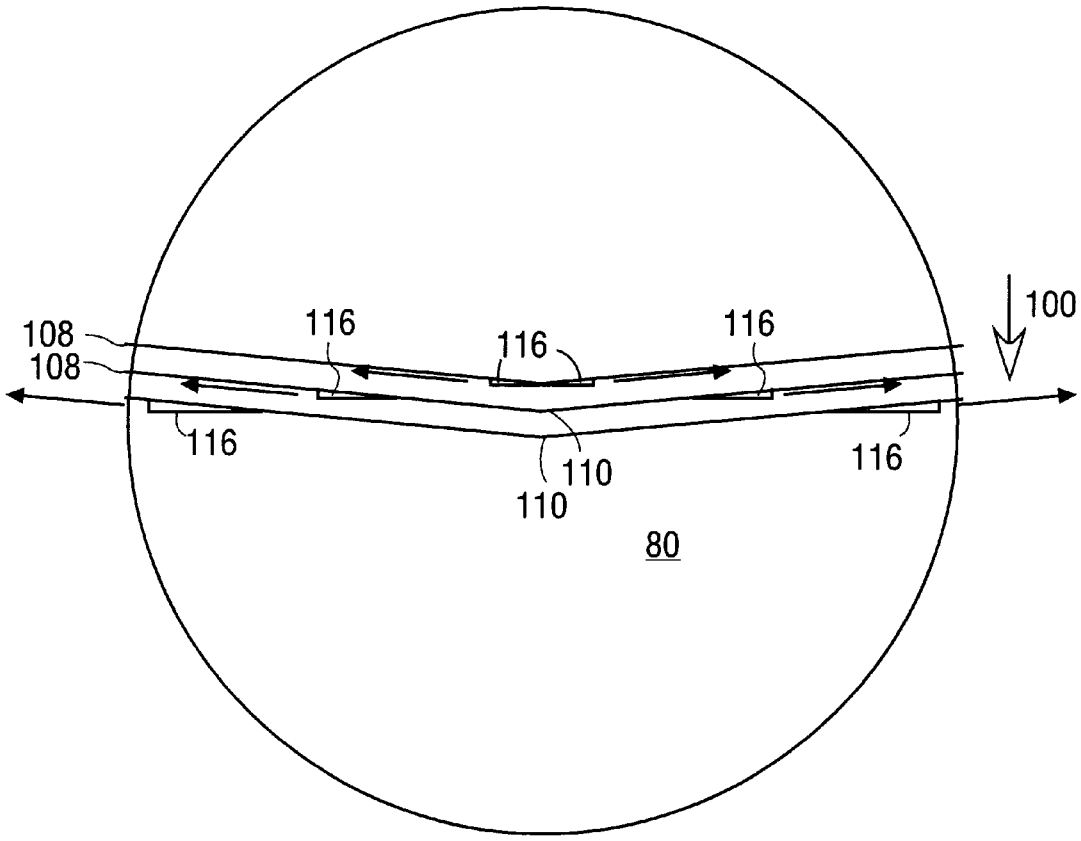
FIG. 13 is a view illustrating the working of the roller of FIG. 12.

The roller 90 of FIG. 10 may cause axial forces on bearings mounting the roller 90 on a mounting arm 64. FIG. 12 illustrates a roller 106 which is similar to the roller 90 of FIG. 10, except that the roller 106 has blades 108 which form "V" shapes 110 in a central region of the roller 106. The roller 106 is rotated in a direction 112 so that the "V" shapes 110 of the blades 108 contact the surface 80 first. At the same time the roller 106 is swept in a direction 114 to condition the surface 80 of the polishing pad 44. As shown in FIG. 13, the roller 108 operates in a similar manner to the roller 110, except that material is first collected near the "V" shapes 110 and then directed to opposing sides of the surface 80. Forces acting on the blades 108 oppose one another so that a resultant axial force of substantially zero results on bearings mounting the roller 106 to a mounting arm 64.

Certain irregularities in the polishing surface of the polishing pad 44, or non-uniformities in the material collecting on the surface 80, sometimes exist with a resulting wafer polish rate which is radially non-uniform. The roller 68 may be shaped to compensate for these irregularities or non-uniformities.

The polishing pad may, for example, have a curved surface in order to obtain certain polishing characteristics, or because of bending of the polishing pad during conditioning. The polishing pad may have a concave polishing surface, a convex polishing surface or may have a surface of any other shape.

Glazing or debris material may collect on the polishing surface in a non-uniform manner. Material usually collects on a rotary polishing pad in a manner wherein the rate of material collection is radially dependent, with a resulting polish rate which is radially non-uniform.

For these and other reasons a cylindrical roller such as the roller 68, the roller 90 or the roller 106 may not produce desired polishing uniformity. A roller is therefore required which has a working surface which is axially profiled in order to compensate for profiled polishing surfaces, or in order to compensate for variations in material deposition rates and therefore non-uniform polish rates.

Figure 14:
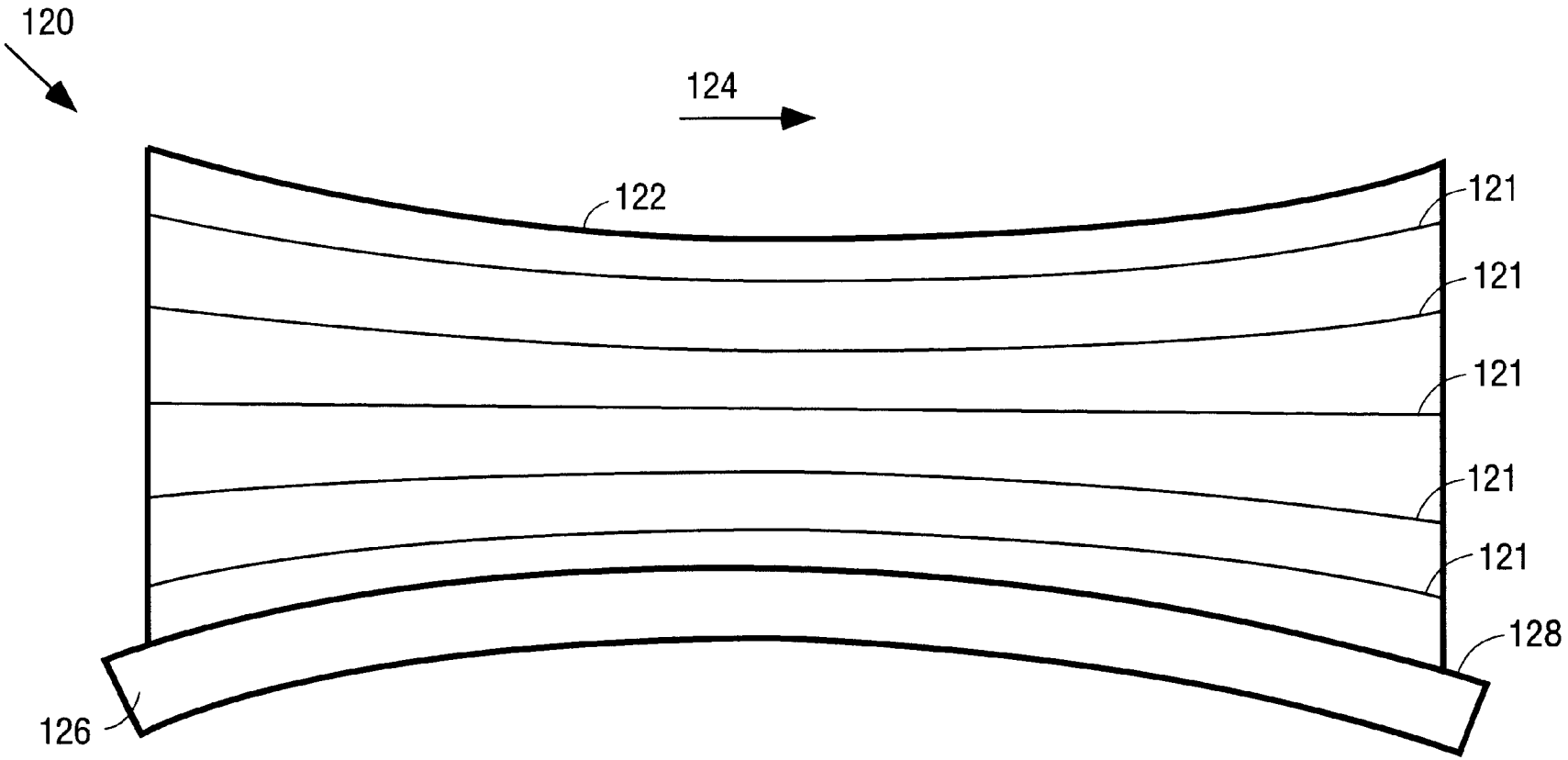
FIG. 14 is a side view of a roller according to yet a further embodiment of the invention, wherein the roller has a concave working surface.

FIG. 14, for example, shows a roller 120 with blades 121 having edges which are profiled. The roller thus has a working surface 122 which is profiled in an axial direction 124. The blades 121 and the working surface 122 are concave. The roller 120 is located on a polishing pad 126 which has a convex polishing surface 128. The concave surface 122 and the convex surface 128 fit one another so that the blades 121 make proper contact with the convex surface 128. Proper contact would result in proper conditioning of the convex surface 128. The roller 120 is substantially the same as the roller 68 of FIG. 6 in all other respects.

Figure 15:
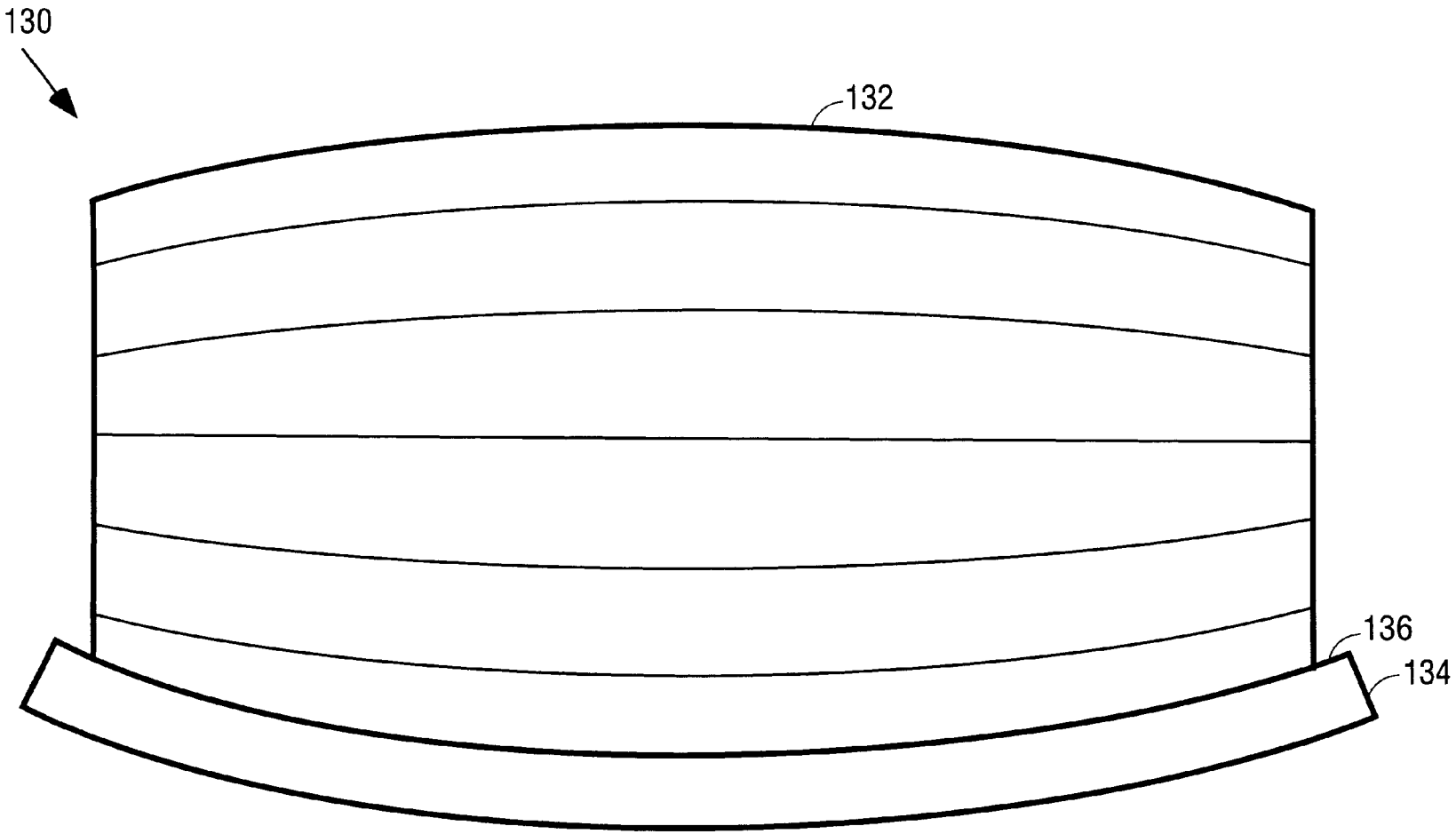
FIG. 15 is a side view of a roller according to yet a further embodiment of the invention, wherein the roller has a convex working surface.

FIG. 15 illustrates a roller 130 having a working surface 132 which is convex. The roller 130 is located on a polishing pad 134 with a concave polishing surface 136. The working surface 132 and the polishing surface 136 complement one another. The roller 130 is substantially the same as the roller 68 of FIG. 6 and the roller 120 of FIG. 14 in all other respects. A combination of convex and concave profiled conditioner rollers may be required.

Figure 16:
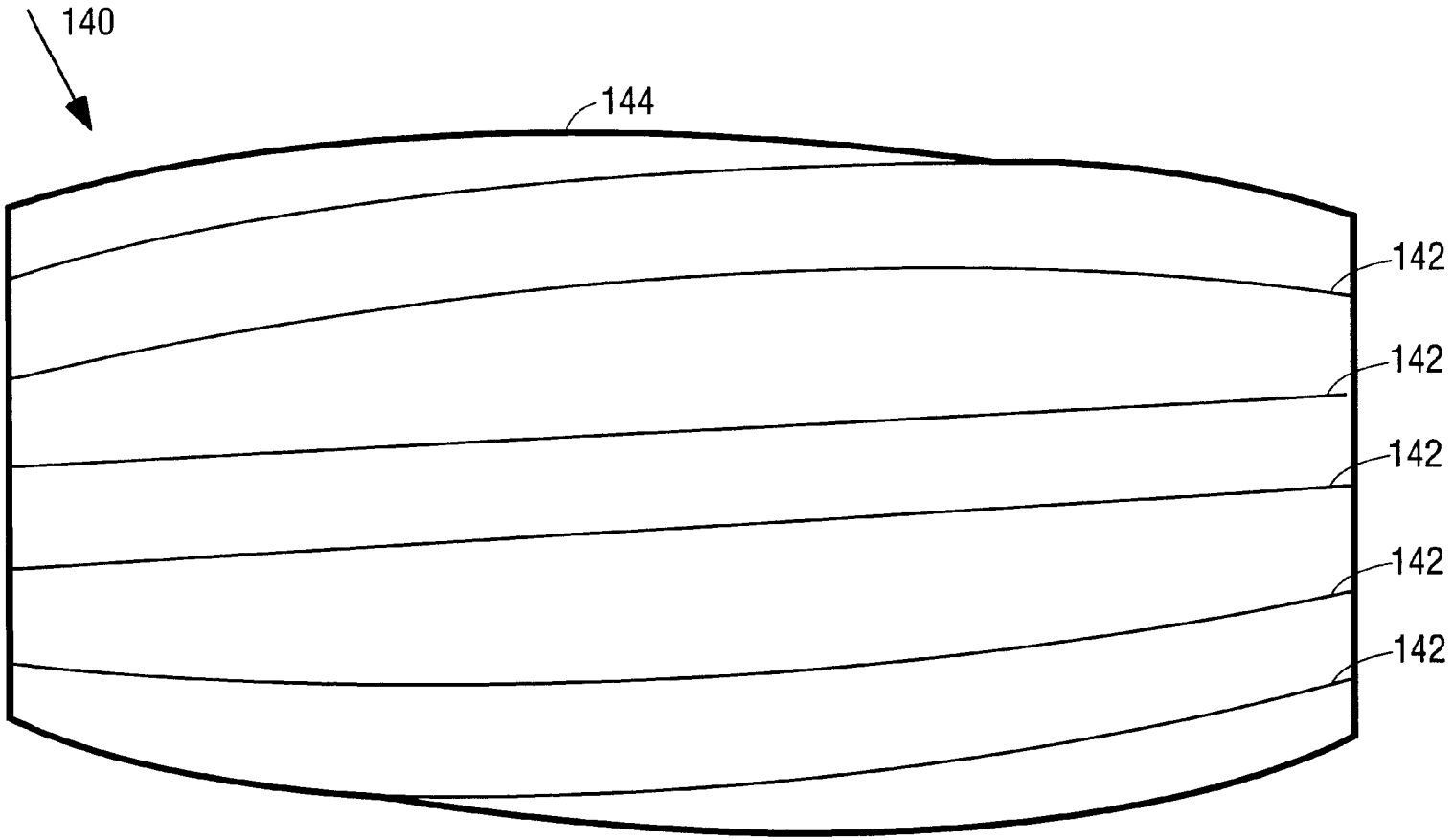
FIG. 16 is a side view of a roller according to yet a further embodiment of the invention wherein the roller has helical blades and a profiled working surface.

The rollers 90 and 106 of FIGS. 10 and 12 respectively may also be provided with working surfaces which are profiled in an axial direction of the roller. FIG. 16, for example, shows a roller 140 with helical blades 142 and a working surface 144 which is profiled. In the embodiment shown in FIG. 16, the working surface is convex in an axial direction of the roller 140.

Figure 17:
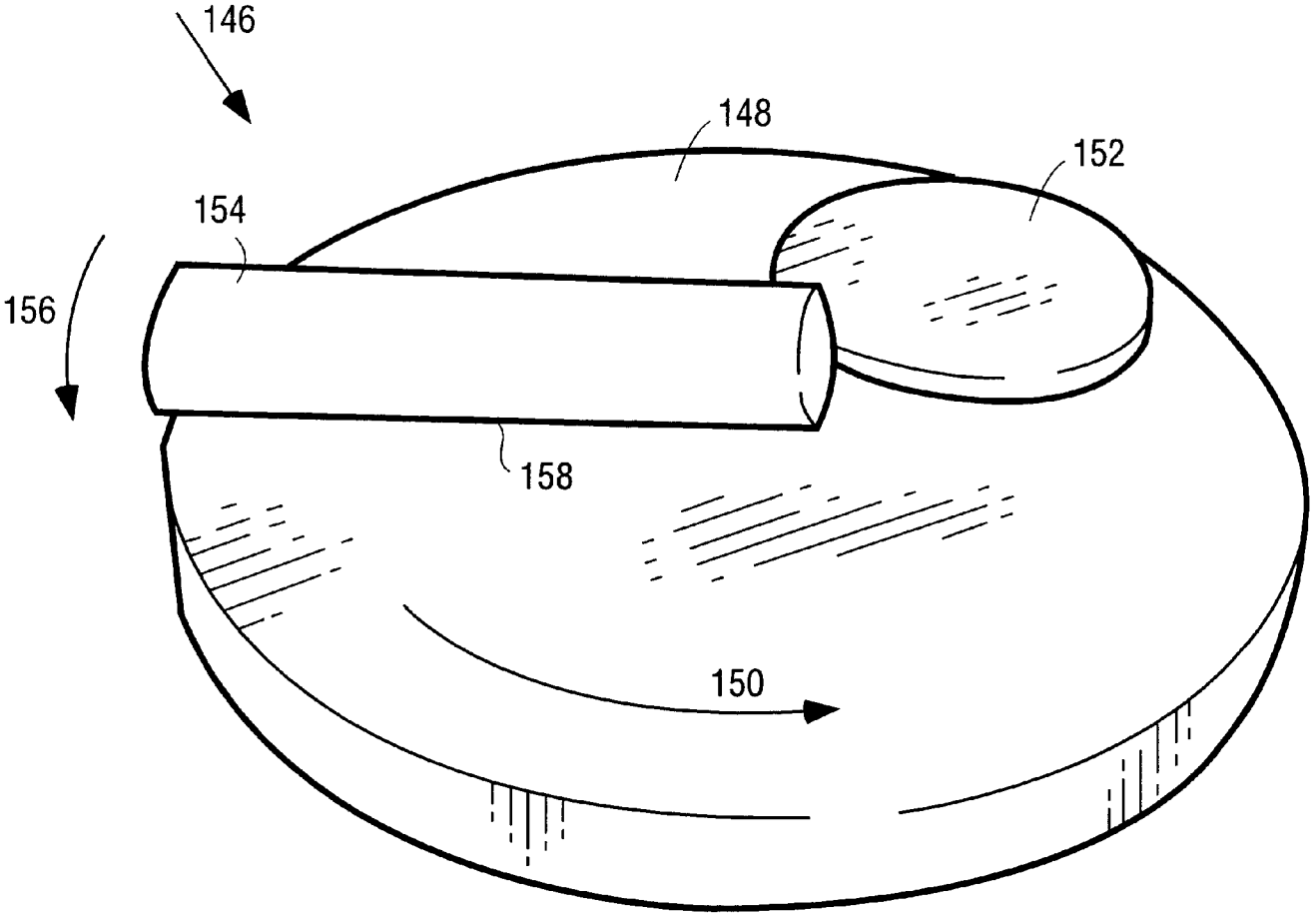
FIG. 17 is a perspective view of a semiconductor wafer processing apparatus according to another form of the invention.

FIG. 17 illustrates a semiconductor processing apparatus 146 according to another form of the invention. The apparatus 146 includes a semiconductor wafer polishing pad 148 which is rotatable in a direction 150. A semiconductor wafer 152 is located on the polishing pad 148 and is held in position by means of a wafer carrier (not shown). A semiconductor wafer polishing pad conditioner roller 154 is located away from the wafer 152 on the polishing pad 148 for in situ conditioning of the polishing pad 148. The polishing pad 148 rotates in the direction 150 to polish the wafer. The roller 154 is located on the polishing pad 148 so as to cover the surface that is glazed by the wafer 152. While the wafer is being polished, the roller 154 is also being rotated in a direction 156 to condition the polishing pad 148. The roller may be of the kind shown in FIGS. 6 to 9, FIG. 10, or FIG. 12, or may have a profiled working surface for purposes as hereinbefore described with reference to FIGS. 14 to 16.

Although the present invention has been described with reference to specific exemplary embodiments, it will be evident that various modifications and changes may be made to these embodiments without departing from the broader spirit and scope of the invention. Accordingly, the specifications and drawings are to be regarded in an illustrative rather than a restrictive sense.

What is claimed:

1. A semiconductor wafer processing apparatus which includes:

a support structure;

a semiconductor wafer polishing pad located on the support structure; and a conditioning blade which is secured to the support structure, wherein the polishing pad and the blade are movable relatively to one another so that the blade scrapes over a surface of the polishing pad, the blade having a continuous edge making line contact on the surface of the polishing pad, wherein the blade is mounted for movement in an orbital path wherein the blade scrapes over a surface of the semiconductor wafer polishing pad during at least a portion of said movement in the orbital path.

2. The apparatus of claim 1 wherein the orbital path is substantially circular.

3. The apparatus of claim 1 which includes a plurality of blades.

4. The apparatus of claim 1 which includes a device which is operable to move the blade in the orbital path.

5. The apparatus of claim 1 wherein the blade extends in a first direction and scrapes in a second direction which is transverse to the first direction.

6. The apparatus of claim 5 wherein the first and second directions are at an angle to one another other than at right angles to one another.

7. The apparatus of claim 1 which includes:

a mounting arm which is secured to the support structure; and a roller which is rotatably mounted to the mounting arm with the blade located on a surface of the roller.

8. The apparatus of claim 7 which includes a plurality of blades located on the surface of the roller.

9. The apparatus of claim 7 wherein the blade forms the surface of the roller.

10. The apparatus of claim 9 wherein the roller is rotatable about an axis oriented at a non-perpendicular angle to the surface of the polishing pad.

11. The apparatus of claim 10 wherein the axis is parallel to the surface of the polishing pad.

12. The apparatus of claim 7 wherein the blade is helical.

13. The apparatus of claim 7 which includes a device which is operable to rotate the roller.

14. The apparatus of claim 7 wherein a mounting arm is mounted for movement to sweep the roller over the semiconductor wafer polishing pad.

15. The apparatus of claim 1 which includes a wafer carrier defining a recess for receiving a semiconductor wafer, the carrier and the polishing pad being movable relatively to one another between a first position wherein the wafer is in contact with the polishing pad and a second position wherein the wafer is moved away from the polishing pad, wherein, when the wafer carrier is in the first position and a wafer is located in the recess, the carrier and the polishing pad are movable relatively to one another to polish the wafer.

16. The apparatus of claim 15 wherein an area of the polishing pad is always covered by the wafer during polishing of the wafer.

17. The apparatus of claim 15 wherein the blade is in contact with the polishing pad when the carrier is in the first position.

18. The apparatus of claim 1 wherein the blade has a profiled scraping edge.

19. A semiconductor wafer processing apparatus which includes a semiconductor wafer polishing pad;

a member which is mounted for movement in an orbital path, wherein the member scrapes over a surface of the semiconductor wafer polishing pad during a portion only of said movement in the orbital path, and wherein the member is a blade; and a motor coupled to the member to drive the member in the orbital path.

20. The apparatus of claim 19 wherein the orbital path is circular.

21. The apparatus of claim 19 wherein the member is rotatable about an axis oriented at a non-perpendicular angle to the surface of the polishing pad.

22. The apparatus of claim 21 wherein the axis is parallel to the surface of the polishing pad.

23. A semiconductor wafer polishing pad conditioner which includes a support structure; and a conditioning blade which is mounted to the support structure for movement in an orbital path.

24. The conditioner of claim 23 wherein the orbital path is substantially circular.

25. The conditioner of claim 23 which includes a plurality of blades.

26. The conditioner of claim 23 which includes a device which is mounted to the support structure, the device being operable to move the blade in the orbital path.

27. The conditioner of claim 23 wherein the blade extends in a first direction and moves in a second direction which is transverse to the first direction.

28. The conditioner of claim 27 wherein the first and second directions are substantially at right angles to one another.

29. The conditioner of claim 27 wherein the first and second directions are at an angle relatively to one another other than at right angles to one another.

30. The conditioner of claim 23 which includes a roller which is rotatably mounted to the support structure with the blade located on a surface of the roller.

31. If The conditioner of claim 30 wherein the blade forms the surface of the roller.

32. The conditioner of claim 30 wherein the blade is helical.

33. The conditioner of claim 32 which includes at least two helical blades forming a "V" shape.

34. The conditioner of claim 23 wherein the blade has a profiled scraping surface.

35. A semiconductor wafer processing apparatus which includes:

a support structure;

a semiconductor wafer polishing pad located on the support structure; and a conditioning blade which is mounted to the support structure for movement in an orbital path wherein the blade scrapes over a surface of the polishing pad during at least a portion of said movement in the orbital path.

36. A semiconductor wafer processing apparatus which includes:

a support structure;

a semiconductor wafer polishing pad located on the support structure; and a conditioning blade which is secured to the support structure, wherein the polishing pad and the blade are movable relatively to one another so that the blade scrapes over a surface of the polishing pad, the blade extending in a first direction and scraping in a second direction which is transverse to the first direction, the first and second directions being at an angle to one another other than at right angles to one another.

37. A semiconductor wafer processing apparatus which includes;

a support structure;

a semiconductor wafer polishing pad located on the support structure;

a mounting arm which is secured to the support structure;

a roller which is rotatably mounted to the mounting arm; and a blade located on a surface of the roller, wherein rotation of the roller causes movement of the blade over the polishing pad so that the blade scrapes over the polishing pad.

* * * * *